US005402090A

United States Patent [19]

Shimizu et al.

[11] Patent Number: 5,402,090

[45] Date of Patent: Mar. 28, 1995

[54] DIELECTRIC FILTER COMPRISED OF TWO DIELECTRIC SUBSTRATES AND COUPLING ELECTRODES DISPOSED WITH THE SUBSTRATES

[75] Inventors: Hiroyuki Shimizu; Kenji Ito, both of Nagoya, Japan

[73] Assignee: NGK Spark Plug Co. Ltd., Aichi, Japan

[21] Appl. No.: 141,057

[22] Filed: Oct. 26, 1993

[30] Foreign Application Priority Data

Oct. 27, 1992 [JP] Japan ..... 4-288355
Oct. 27, 1992 [JP] Japan ..... 4-288475

[51] Int. Cl.[6] ..... H01P 1/205
[52] U.S. Cl. ..... 333/206; 333/222
[58] Field of Search ..... 333/202-207, 333/222, 223, 246

[56] References Cited

U.S. PATENT DOCUMENTS 4,673,902 6/1987 Takada et al. ..... 333/202
5,144,269 9/1992 Itoh ..... 333/206
5,248,949 9/1993 Eguchi et al. ..... 333/246 X

FOREIGN PATENT DOCUMENTS 0510971 10/1992 European Pat. Off. ..... 333/204
2675638 10/1992 France ..... 333/202
59-114902 7/1984 Japan .
0119901 7/1984 Japan ..... 333/202
63-60603 3/1988 Japan .
63-90202 4/1988 Japan .

*Primary Examiner*—Seungsook Ham
*Attorney, Agent, or Firm*—Larson & Taylor

[57] ABSTRACT

A dielectric filter in which input/output coupling electrode layers are arranged on the surfaces of the substrate sections, separated from the resonating conductors by an adjustable distance, the coupling capacitance of the device can be chosen within a wide range of selection because of the relatively large area of the surfaces. The dielectric filter comprises an interstage coupling electrode layer which is formed on a temporary surface of a dielectric substrate that has a relatively large area and becomes internal in the final product with a predetermined but adjustable distance from a pair of resonating conductors arranged in the dielectric substrate.

8 Claims, 5 Drawing Sheets

FIG. 6
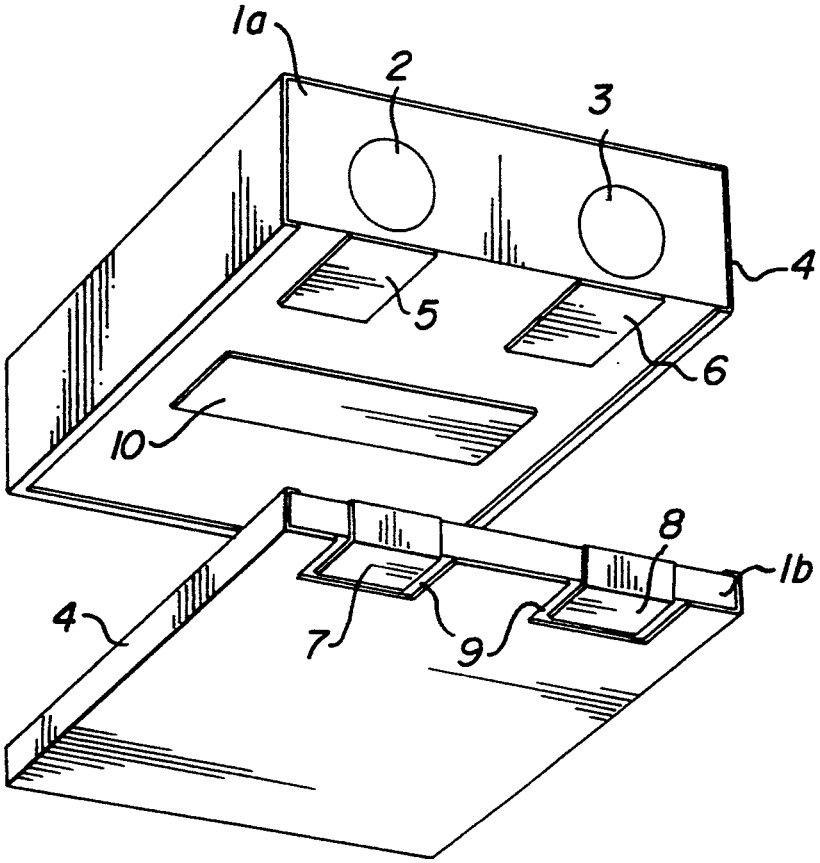
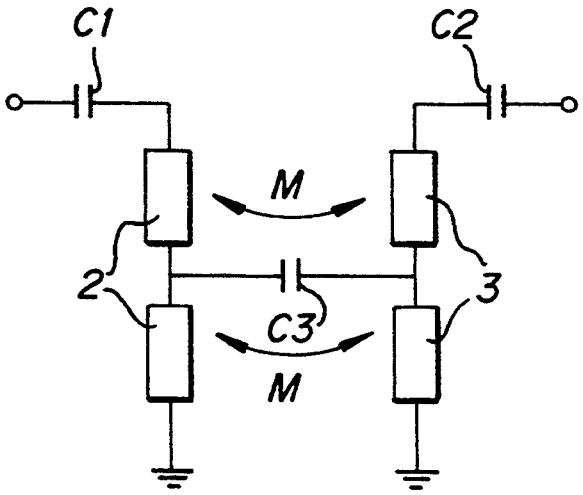
FIG. 7

DIELECTRIC FILTER COMPRISED OF TWO DIELECTRIC SUBSTRATES AND COUPLING ELECTRODES DISPOSED WITH THE SUBSTRATES

BACKGROUND OF THE INVENTION

The present invention relates to a dielectric filter to be suitable used as a band-pass filter or the like.

As is well known, such a dielectric filter operating as a band-pass filter has a pass bandwidth which is defined by its coupling coefficient. The coupling coefficient of the dielectric filter can be modified to some extent by changing the distance separating its resonators and/or arranging a coupling adjusting hole on it. However, either the distance between the resonators needs to be made extremely small or a very large coupling adjusting hole has to be formed in order to achieve a large coupling coefficient. Then, the filter will show a disproportionally small space separating the resonators or the resonators and the coupling adjusting hole. The process of manufacturing such a filter will inevitably become complicated and an extremely enhanced level of precision machining will become necessary if such a filter has to be down-shed. Dielectric filters of various types have been proposed to overcome these problems by arranging a coupling capacitor on the outer surface of the dielectric substrate of the filter in order to modify the coupling capacitance of the filter.

For instance, Japanese Patent Kokai No. 59-114902 discloses a dielectric filter realized by introducing a plurality of conductors operating as so many resonators into respective holes bored through a dielectric block from a side to the other, an end of each of the conductors being connected to a common conductive film arranged on the outer surface of the dielectric block to form a short-circuit terminal, the other end being left free to form an open-circuit terminal, and arranging a capacitor close to said open-circuit terminals on the surface of said dielectric block to realize capacitance-coupling of said open-circuit terminals of the conductors so that any desired coupling capacitance can be produced for the resonators by appropriately selecting the capacitance of the capacitor.

On the other hand, Japanese Patent Publication No. 3-40962 (U.S. Pat. No. 4,673,902) discloses a dielectric filter realized by introducing internal conductors operating as so many resonators into respective holes bored through a cubic dielectric block from a side to the other, short-circuiting an end of each of said internal conductors by forming an external conductor film as a short-circuit terminal plane on the side of the dielectric block exposing said ends of the internal conductors, leaving the opposite side of the dielectric block exposing said other ends of the internal conductors as an open-circuit terminal plane, a capacitor electrode being disposed on said open-circuit terminal plane for capacitance coupling.

It should be noted that the coupling capacitance between the input/output section and the resonators of a conventional dielectric filter of any of the above types is defined by the capacitance of the capacitor arranged on the outer surface of the dielectric block of the filter and comprising a first electrode disposed on or electrically connected to the open-circuit terminal plane and a second electrode disposed adjacent to said first electrode, said electrodes being normally located on a surface where no external conductor of the dielectric block is found, so that the electrodes are subjected to a certain dimensional limit. More specifically, while the electrodes may be made large by using a considerably large dielectric block, such a large dielectric block may not feasibly be used for a down-sized dielectric filter of any of the types under consideration. Thus, the known techniques can only provide a dielectric filter with a small coupling capacitance and an extremely high sensitivity to external electromagnetic fields and precision machining operations will become necessary if a coupling capacitance of a desired level needs to be realized for the electrodes to be formed.

With any of the above described known dielectric filters, also, it is difficult to polarize the attenuation band of the filter. Incidentally, known techniques for polarization of the attenuation band of a dielectric filter include the one where adjacent open-circuit terminals of dielectric resonators are connected with each other by way of respective reactance devices arranged on the outer surface of the filter and a parallel resonance circuit is formed among the reactance devices and held in an anti-resonance state at a specific frequency in order to polarize the attenuation band (e.g., Japanese Patent Kokai No. 63-60603) and the one where an external conductor and internal conductors are arranged respectively on the outer surface of a dielectric block and the inner peripheral surfaces of holes bored through the dielectric block and grooves cut along strips separating adjacent internal conductors are covered by a conductive film electrically connected to the external conductor, said internal conductors being mutually coupled by different polarities in order to polarize the attenuation band (see Japanese Patent kokai No. 63-90202). However, a dielectric filter realized by using the former technique is excessively sensitive to external electromagnetic fields because a reactance device is formed on the free terminal plane of the filter, whereas one realized by means of the latter technique has a very complicated configuration and therefore requires exquisitely fine machining operations, practically prohibiting any attempt to meet the requirement of down-sizing.

All in all, with any of the known techniques, it is difficult, if not impossible, to provide a down-sized dielectric filter having a polarized attenuation band and dielectric filters prepared by known techniques are normally excessively sensitive to external electromagnetic fields in operation. Additionally such devices require a high degree of precision machining to raise the overall manufacturing cost.

SUMMARY OF THE INVENTION

It is, therefore, an object of the present invention to provide a dielectric filter that is free from the above identified problems and, at the same time, capable of adjusting the coupling capacitance between the input/output section and the resonators to a satisfactorily large extent without requiring a high degree of precision machining.

Another object of the present invention is to provide a dielectric filter that is free from the above identified problems and, at the same time, capable of meeting the requirement of down-sizing and that of possessing a polarized attenuation band and adjusting the coupling capacitance between the input/output section and the resonators to a satisfactorily large extent without requiring a high degree of precision machining.

According to the present invention, the above first object is achieved by providing a dielectric filter characterized in that a plurality of resonating conductors are arranged in parallel with each other and disposed substantially at the middle between the upper and lower surfaces of a dielectric substrate, said resonating conductors extending between the front and rear extremities of said dielectric substrate, an end of each of said resonating conductors is connected to a common external conductor arranged on the outer peripheral surfaces of said dielectric substrate to form a short-circuit terminal, the other end is left unconnected to said external conductor to form an open-circuit terminal, said dielectric substrate is divided into two dielectric substrate sections by a first plane parallel to a second plane passing through but not intersecting said resonating conductors, and an input and output coupling electrode layers are arranged on the inner surface of at least one of said dielectric substrate sections to be stacked to each other so that they are opposite to the open-circuit terminals of the respective resonating conductors.

According to another aspect of the present invention, there is provided a dielectric filter characterized in that a plurality of resonating conductors are arranged in parallel with each other and disposed substantially at the middle between the upper and lower surfaces of a dielectric substrate, said resonating conductors extending between the front and rear extremities of said dielectric substrate, an end of each of said resonating conductors is connected to a common external conductor arranged on the outer peripheral surfaces of said dielectric substrate to form a short-circuit terminal, the other end is left unconnected to said external conductor to form an open-circuit terminal, said dielectric substrate is divided into two dielectric substrate sections by a first plane parallel to a second plane passing through but not intersecting said resonating conductors, and an interstage coupling electrode layer is arranged on the inner surface of at least one of said layered dielectric substrate sections and extending across said resonating conductors.

The dielectric filter according to the second aspect of the invention may further comprise an input coupling electrode layer and an output coupling electrode layer arranged opposite to said open-circuit terminals of said resonating conductors on said inner surface.

Since a dielectric filter according to the invention comprises an interstage coupling electrode layer extending across its resonating conductors, the attenuation band of the filter is polarized as a function of the size and location of the interstage coupling electrode layer and the coupling of the magnetic fields of the resonating conductors as illustrated in FIG. 8 of the accompanying drawings.

Additionally, since the dielectric substrate of a dielectric filter according to the invention is divided into two sections, one having resonating conductors in the inside and the other arranged on the first section to produce a double-layer structure, and an interstage coupling electrode layer is arranged on the inner surface of at least one of the layered dielectric substrate sections, interstage coupling is realized within the dielectric substrate to make the device less sensitive to external electromagnetic fields in operation.

Finally, since a dielectric filter according to the invention may additionally comprise input and output coupling electrode layers arranged opposite to the open terminals of the resonating conductors on the inner surface, the area of the coupling electrode layers is less subjected to limitations. Moreover, a greater freedom is allowed to the selection of the distance separating the resonating conductors arranged within one of the dielectric substrate sections and the input/output coupling electrode layers because of the fact that the dielectric substrate may be divided into two sections at an arbitrarily selected level.

The present invention will now be described in greater detail with reference to the accompanying drawings that illustrate preferred embodiments of the invention.

BRIEF DESCRIPTION OF THE DRAWINGS

FIG. 6 is a schematic exploded perspective view of the embodiment of FIG. 4 as viewed from below, showing its dielectric substrate sections including another surface that also becomes internal when the sections are bonded together;

FIG. 7 is an equivalent circuit diagram of the dielectric filter of FIGS. 4 through 6.

DETAILED DESCRIPTION

Figure 1:
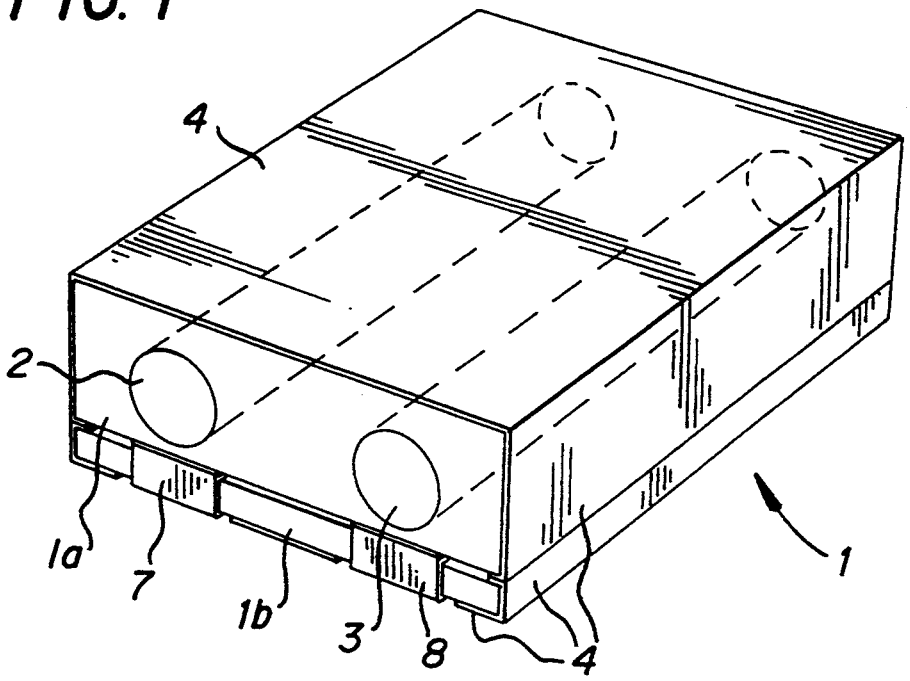
FIG. 1 is a schematic perspective view of a preferred embodiment of dielectric filter of the present invention.
Figure 2:
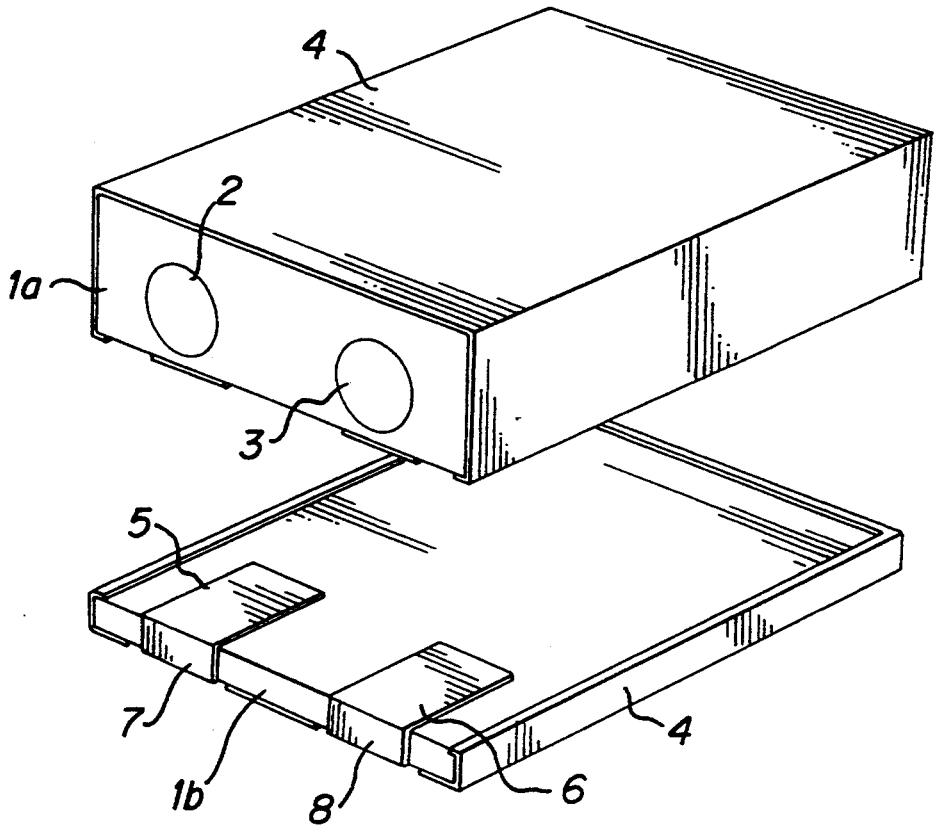
FIG. 2 is a schematic exploded perspective view of the embodiment of FIG. 1 as viewed from above, showing its dielectric substrate sections including a surface that becomes internal when the sections are bonded together.
Figure 3:
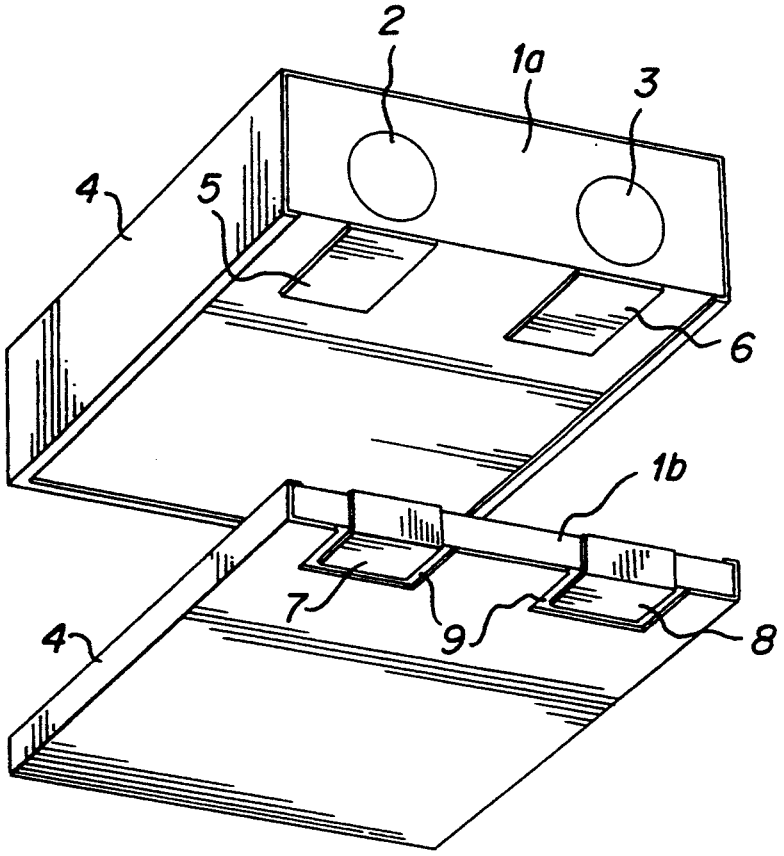
FIG. 3 is a schematic exploded perspective view of the embodiment of FIG. 1 as viewed from below, showing its dielectric substrate sections including another surface that also becomes internal when the sections are bonded together.

Referring firstly to FIGS. 1 through 3 that schematically illustrate an embodiment of the invention, a dielectric filter comprises a substrate 1 made of a dielectric ceramic material and divided into a relatively thick first dielectric substrate section 1*a* and a relatively thin second dielectric substrate section 1*b*, which are layered and bonded together at the time of assembling. A pair of oblong resonating conductors 2 and 3 are arranged in parallel with each other in the thick first dielectric substrate section 1*a*, extending all the way between the front and rear ends thereof. An external conductor layer 4 is formed on the outer peripheral surfaces of the dielectric substrate sections 1*a* and 1*b* except the front end thereof. As shown in FIGS. 2 and 3, the external conductor layer 4 extends to the inner edges of the dielectric substrate sections 1*a* and 1*b* so that the opposite extremities of the layer securely contact with each other when the two dielectric substrate sections 1*a* and 1*b* are put together. Thus, an end of each of the resonating conductors 2 and 3 is short-circuited by the external conductor layer 4 at the rear end of the substrate 1 to form a short-circuit terminal, while the other ends of the resonating conductors 2 and 3 extend to the front extremity of the substrate 1 carrying no external conductor layer 4 thereon to form respective open-circuit terminals.

As shown in FIGS. 2 and 3, an input coupling electrode layer 5 and an output coupling electrode layer 6 are arranged at respective positions close to the open-circuit terminals of the resonating conductors 2 and 3 on each of the opposite sides of the dielectric substrate sections 1*a* and 1*b* that come to contact with each other when the substrate sections are put together. By provision of the input/output coupling electrode layers 5 and 6 on the respective dielectric substrate sections 1*a* and 1*b* no space is left within the dielectric filter when the two substrate sections are stacked together.

As seen from FIG. 3, the input/output coupling electrode layers 5 and 6 are connected to respective input-/output terminals 7 and 8 arranged on the second dielectric substrate sections 1*b*, extending from the front end to an outer surface thereof, a space 9 being arranged between the input/output terminals 7 and 8 and the external conductor layer 4 on the outer surfaces of the dielectric substrate section 1*b* in order to electrically insulate them from each other.

The two dielectric substrate sections 1*a* and 1*b*, each provided with input/output coupling electrode layers 5, 6 and the external conductor layer 4 are put together and bonded together to form a comb line type dielectric filter.

The coupling capacitance of the illustrated dielectric filter having a configuration as described above can be modified by changing the sizes (surface areas) of the input/output coupling electrode layers 5 and 6 and/or the space separating the resonating conductors disposed in the first dielectric substrate section 1*a* and the input-/output coupling electrode layers 5 and 6 arranged on the surface of the first substrate section that comes to contact with the corresponding opposite surface of the other substrate section. It should be noted here that, since the surface of the dielectric substrate section carrying thereon the input/output coupling electrode layers 5 and 6 has a surface area greater than those of any other surfaces of the section, the areas of the input/output coupling electrode layers 5 and 6 can be varied over a wide range to allow a wide selection for the coupling capacitance. Additionally, since the input/output coupling electrode layers 5 and 6 are located inside the dielectric substrate, the device becomes less sensitive to external electromagnetic fields.

For manufacturing the illustrated dielectric filter having a configuration as described above, the dielectric substrate 1 may be produced either by combining two substrate sections that have been prepared separately in advance or by inserting a pair of resonating conductors 2 and 3 substantially at the middle between the upper and lower surfaces of the dielectric substrate 1, cutting the substrate into halves along a plane which is parallel to and spaced by a given distance from a plane running through the resonating conductors 2 and 3, the distance being determined as a function of the intended coupling capacitance, and then connecting the halves together once again.

With the illustrated embodiment, resonating conductors 2 and 3 may be arranged to have an interdigital configuration in which the open-circuit terminals and the short-circuit terminals are disposed at the opposite sides, respectively.

The illustrated device may comprise three or more resonating conductors.

While input/output coupling electrode layers 5 and 6 are arranged on each of the two substrate sections in the illustrated second embodiment, either of the substrate sections may be devoid of these electrode layers if no space is left within the dielectric filter when the two substrate sections are stacked together.

Also, the resonating conductors do not necessarily have a circular cross section and may take an appropriate shape depending on the circumstances.

The dielectric filter of the first embodiment may alternatively be prepared by arranging resonating conductors in the dielectric substrate at such positions that they are spaced from the upper and lower surfaces of the dielectric substrate by respective predetermined distances (or resonating conductors may be arranged at arbitrarily selected positions in the dielectric substrate and then the latter may be cut along the upper or lower surface until the distances separating the resonating conductors from the upper and lower surfaces reach respective predetermined values), then input/output coupling electrode layers on either the upper surface or the lower surface of the dielectric substrate separated from the resonating conductors by a given distance at positions corresponding to the respective open extremities of the resonating conductors and finally bonding a separately prepared cover onto the upper or lower surface of the substrate where the electrode layers are arranged.

Figure 4:
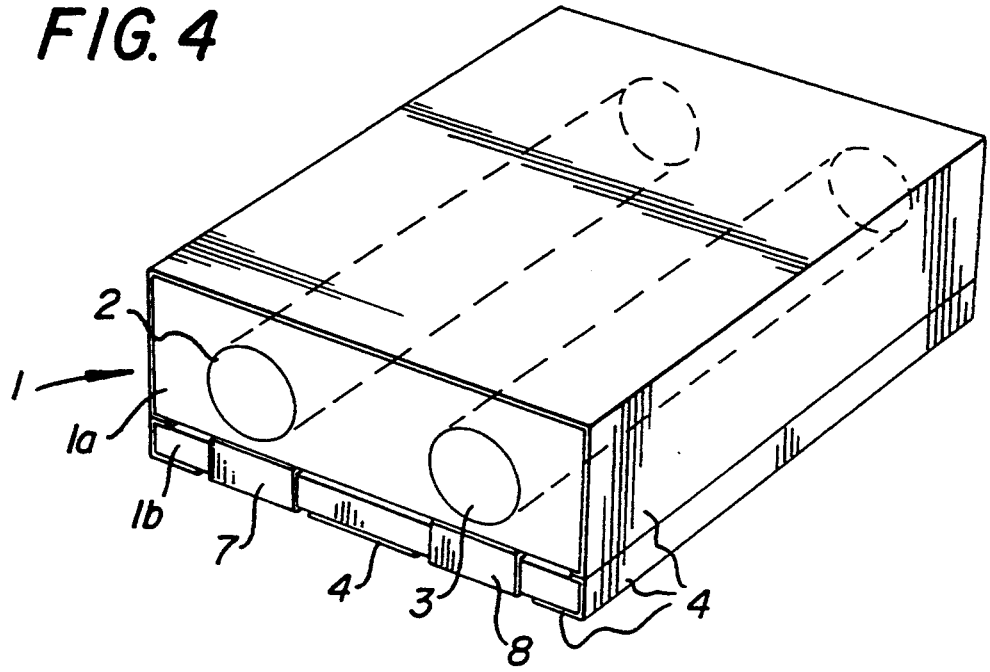
FIG. 4 is a schematic perspective view of another embodiment of dielectric filter of the present invention.
Figure 5:
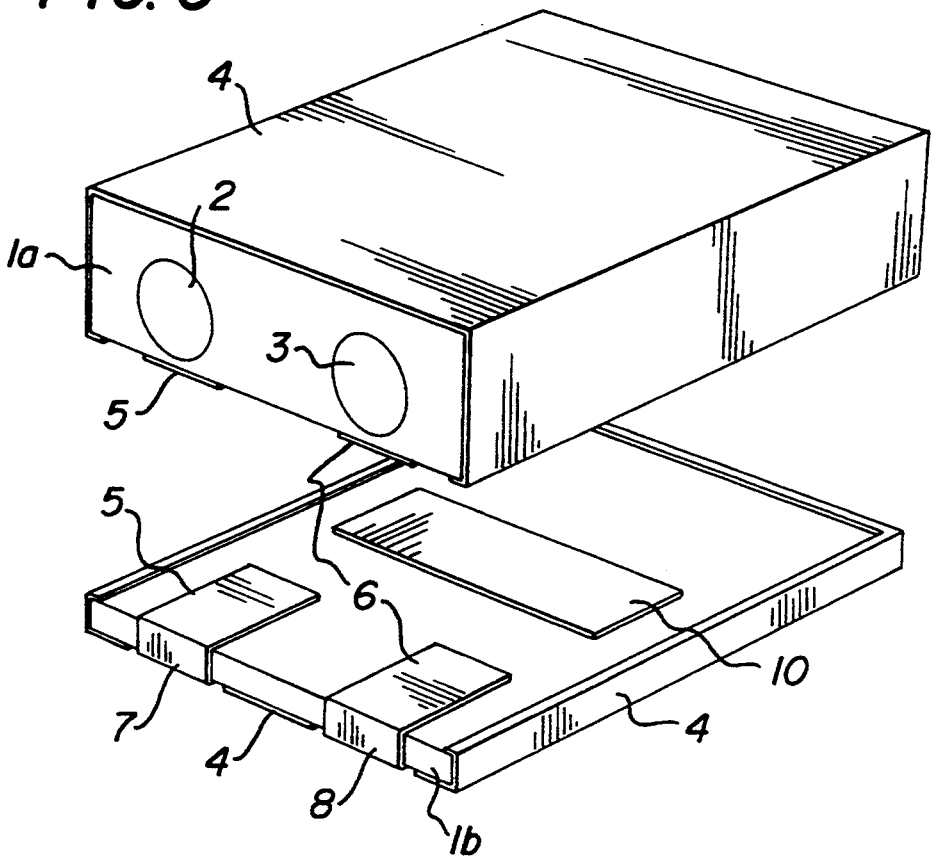
FIG. 5 is a schematic exploded perspective view of the embodiment of FIG. 4 as viewed from above, showing its dielectric substrate sections including a surface that becomes internal when the sections are bonded together.
Figure 8:
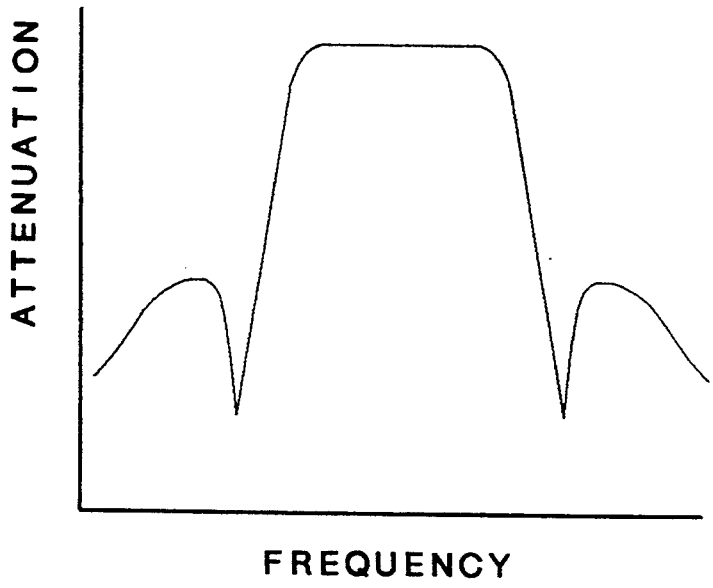
FIG. 8 is a graph showing the relationship between the attenuation level and the frequency in the characteristic of the dielectric filter of FIGS. 4 through 6.

FIGS. 4 to 6 illustrate a second embodiment of the present invention and their components corresponding to their respective counterparts of the first embodiment are respectively indicated with the same reference numerals. In the second embodiment, as shown in FIGS. 5 and 6, an interstage coupling electrode layer 10 is arranged on each of the above identified sides of the substrate sections 1*a* and 1*b*, extending across the resonating conductors 2 and 3. The interstage coupling electrode layers 10 arranged at the corresponding respective positions of the dielectric substrate sections 1*a* and 1*b* and extending across the resonating conductors 2 and 3 operate to polarize the attenuation band of the filter as typically indicated by the graph of FIG. 8. The two dielectric substrate sections 1*a* and 1*b*, each provided with input/output coupling electrode layers 5 and 6, the interstage coupling electrode layer 10 and the external conductor layer 4 are put together and bonded together to form a comb line type dielectric filter.

FIG. 7 shows an equivalent circuit of the dielectric filter of FIGS. 4–6.

Referring to FIG. 7, C1 denotes an input capacitor comprising the input coupling electrode latter 5 and C2 denotes an output capacitor comprising the output coupling electrode layer 6, while C3 denotes an interstage coupling capacitor comprising the interstage coupling electrode layer 10.

In the second embodiment, the coupling capacitance of the illustrated dielectric filter having a configuration as described above can be modified by changing the sizes (surface areas) of the input/output coupling electrode layers 5 and 6 and the interstage coupling electrode layer 10 and/or the space separating the resonating conductors disposed in the first dielectric substrate section 1*a* and the input/output coupling electrode layers 5 and 6 and the interstage coupling electrode layer 10. It should be appreciated that, since the surface of the dielectric substrate section carrying thereon the input/output coupling electrode layers 5 and 6 and the interstage coupling electrode layer 10 has a surface area greater than those of any other surfaces of the section, the areas of the input/output coupling electrode layers 5 and 6 and the interstage coupling electrode layer 10 can be varied over a wide range to allow a wide selection for the coupling capacitance. Further, since the input/output coupling electrode layers 5 and 6 and the interstage coupling electrode layer 10 are located inside the dielectric substrate, the device becomes less sensitive to external electromagnetic fields.

As in the case of the first embodiment, with the second embodiment, the dielectric substrate 1 may be produced either by combining two substrate sections that have been prepared separately in advance or by inserting a pair of resonating conductors 2 and 3 substantially at the middle between the upper and lower surfaces of a dielectric substrate 1, cutting the substrate into halves along a plane which is parallel to and spaced by a given distance from a plane running through the resonating conductors 2 and 3, the distance being determined as a function of the intended coupling capacitance, and then connecting the halves together once again.

While input/output coupling electrode layers 5 and 6 and the interstage coupling electrode layer 10 are arranged on each of the two substrate sections in the illustrated second embodiment, either of the substrate sections may be devoid of these electrode layers if no space is left within the dielectric filter when the two substrate sections are stacked together.

Also, the resonating conductors do not necessarily have a circular cross section and may take an appropriate shape depending on the circumstances.

The dielectric filter of the second embodiment may alternatively be prepared by arranging resonating conductors in the dielectric substrate at such positions that they are spaced from the upper and lower surfaces of the dielectric substrate by respective predetermined distances (or resonating conductors may be arranged at arbitrarily selected positions in the dielectric substrate and then the latter may be cut along the upper and lower surfaces until the distances separating the resonating conductors from the upper and lower surfaces reach respective predetermined values), then input/output coupling electrode layers on either the upper surface or the lower surface of the dielectric substrate separated from the resonating conductors by a given distance at positions corresponding to the respective open extremities of the resonating conductors and the interstage coupling electrode layer are arranged so as to extend across the resonating conductor and then bonding a separately prepared cover onto the upper or lower surface of the substrate where the electrode layers are arranged.

As described above in detail, since, with a dielectric filter according to the invention, input/output coupling electrode layers are arranged on the surfaces of the substrate sections, separated from the resonating conductors by an adjustable distance, the coupling capacitance of the device can be chosen within a wide range of selection because of the relatively large area of the surfaces. The range of selection of the coupling capacitance is even more broadened by the fact that the sizes of the input/output coupling electrode layers may be freely selected within relatively loose limits.

Further, the fact that the input/output coupling electrode layers are arranged inside the dielectric substrate allows the dielectric filter not only to be down-sized but also to be practically unaffected by external electromagnetic fields in operation so that the filter may stably operate.

Furthermore, by provision of the interstage coupling electrode layer which is arranged on the surface of each of a pair of substrate sections that comes to contact with the corresponding surface of its counterpart, extending across the resonating conductors disposed in the substrate, the dielectric filter is hardly affected by external electromagnetic fields and the attenuation band of the filter can be polarized so that consequently the filter shows excellent attenuation characteristics while satisfying the requirement of down-sizing.

When, in addition to the provision of the interstage coupling electrode layer, input/output coupling electrode layers are arranged on the surfaces of the substrate sections, separated from the resonating conductors by an adjustable distance, as described in the above the coupling capacitance of the device can be chosen within a wide range of selection because of the relatively large area of the surfaces. The range of selection of the coupling capacitance is even more broadened by the fact that the sizes of the input/output coupling electrode layers and the interstage coupling electrode layer may be freely selected within relatively loose limits.

Thus, the present invention succeeds in providing a dielectric filter that can be down-sized and manufactured without difficulties because of it structural features and that offers a wide selection for the coupling capacitance and is practically unaffected by external electromagnetic fields and capable of polarizing the attenuation band.

It is to be understood that the above-mentioned embodiments are only illustrative of the application of the principles of the present invention. Numerous modifications and alterations may be made by those skilled in the art without departing from the sprit and scope of the invention.

We claim:

1. A dielectric filter comprising:

a dielectric substrate having outer peripheral surfaces including an upper surface, a lower surface, a front extremity, and a rear extremity, a plurality of holes extending from said front extremity to said rear extremity, said holes having longitudinal axes which are parallel, coplanar in a first plane, and disposed substantially midway between said upper surface and said lower surface, and a second plane parallel to said first plane along which said dielectric substrate is divided only into respective opposed substrate sections with one of said substrate sections including said holes, said substrate sections including facing surfaces and being stacked to form said substrate;

a common external conductor arranged on all of the outer peripheral surfaces except said front extremity;

a resonating conductor provided in each said hole, each said resonating conductor extending between said rear extremity where a short-circuit end thereof is in contact with said external conductor and said front extremity where an open-circuit end thereof is provided; and an input coupling electrode layer and an output coupling electrode layer arranged on one of the facing surfaces of said substrate sections, said layers being respectively positioned adjacent a respective open terminal end of said resonating conductors.

2. A dielectric filter as claimed in claim 1 and further including an input terminal and an output terminal connected respectively to said input coupling electrode layer and said output coupling electrode layer, said input and output terminals being disposed along an outer peripheral surface.

3. A dielectric filter as claimed in claim 1 wherein said substrate sections are a first substrate section including said holes and a second substrate section which is thinner in a direction perpendicular to said first plane than said first substrate section.

4. A dielectric filter comprising:

a dielectric substrate having outer peripheral surfaces including an upper surface, a lower surface, a front extremity, and a rear extremity, a plurality of holes extending from said front extremity to said rear extremity, said holes having longitudinal axes which are parallel, coplanar in a first plane, and disposed substantially midway between said upper surface and said lower surface, and a second plane parallel to said first plane along which said dielectric substrate is divided only into respective opposed substrate sections with one of said substrate sections including said holes, said substrate sections including facing surfaces and being stacked to form said substrate;

a common external conductor arranged on all of the outer peripheral surfaces except said front extremity;

a resonating conductor provided in each said hole, each said resonating conductor extending between said rear extremity where a short-circuit end thereof is in contact with said external conductor and said front extremity where an open-circuit end thereof is provided;

an interstage coupling electrode layer arranged on one of the facing surfaces of said substrate sections, said interstage coupling electrode layer extending adjacently between said resonating conductors; and an input terminal and an output terminal disposed along an outer peripheral surface.

5. A dielectric filter as claimed in claim 4 wherein said substrate sections are a first substrate section including said holes and a second substrate section which is thinner in a direction perpendicular to said first plane than said first substrate section.

6. A dielectric filter comprising:

a dielectric substrate having outer peripheral surfaces including an upper surface, a lower surface, a front extremity, and a rear extremity, a plurality of holes extending from said front extremity to said rear extremity, said holes having longitudinal axes which are parallel, coplanar in a first plane, and disposed substantially midway between said upper surface and said lower surface, and a second plane parallel to said first plane along which said dielectric substrate is divided only into respective opposed substrate sections with one of said substrate sections including said holes, said substrate sections including facing surfaces and being stacked to form said substrate;

a common external conductor arranged on all of the outer peripheral surfaces except said front extremity;

a resonating conductor provided in each said hole, each said resonating conductor extending between said rear extremity where a short-circuit end thereof is in contact with said external conductor and said front extremity where an open-circuit end thereof is provided;

an input coupling electrode layer and an output coupling electrode layer arranged on one of the facing surfaces of said substrate sections, said layers being respectively positioned adjacent a respective open terminal end of said resonating conductors; and an interstage coupling electrode layer arranged on one of the facing surfaces of said substrate sections, said interstage coupling electrode layer extending adjacently between said resonating conductors.

7. A dielectric filter as claimed in claim 6 and further including an input terminal and an output terminal connected respectively to said input coupling electrode layer and said output coupling electrode layer, said input and output terminals being disposed along an outer peripheral surface.

8. A dielectric filter as claimed in claim 6 wherein said substrate sections are a first substrate section including said holes and a second substrate section which is thinner in a direction perpendicular to said first plane than said first substrate section.

* * * * *